United States Patent [19]

Waller et al.

[11] Patent Number: 4,683,028

[45] Date of Patent: Jul. 28, 1987

[54] MOULDING

[75] Inventors: Martin Waller; Geoffrey Farrell, both of Bolton; Kenneth W. Mills, deceased, late of Freckleton; by Margaret Mason, executor; by Geoffrey A. Shindler, executor, both of Manchester, all of England

[73] Assignee: Vernon and Company (Pulp Products) Limited, Lancashire, England

[21] Appl. No.: 698,888

[22] Filed: Feb. 6, 1985

[30] Foreign Application Priority Data

Feb. 10, 1984 [GB] United Kingdom ..... 8403507

[51] Int. Cl.[4] ..... D21J 7/00

[52] U.S. Cl. ..... 162/275; 162/218; 162/382; 162/388; 162/410; 425/85; 425/225; 425/451; 425/451.5; 249/170

[58] Field of Search ..... 162/218, 388, 382, 387, 162/389, 410; 425/85, 225, 84, 175, 176, 179, 451, 451.5; 264/86, 87; 249/170

[56] References Cited

U.S. PATENT DOCUMENTS

| | | | |
|---|---|---|---|
| 1,497,915 | 6/1924 | Kelleher et al. | 162/388 |
| 1,719,819 | 7/1929 | Koppelman | 162/388 |
| 2,048,045 | 7/1936 | Adams | 162/382 |
| 2,923,352 | 2/1960 | Leitzel | 162/388 |
| 2,961,043 | 11/1960 | Hicks | 425/85 |
| 2,967,568 | 1/1961 | Friday | 162/382 |
| 4,047,358 | 9/1977 | Heffehan et al. | 264/510 |
| 4,082,492 | 1/1987 | Kurreck | 425/451 |
| 4,161,377 | 7/1979 | Strawson et al. | 425/85 |
| 4,335,065 | 6/1982 | Ando | 425/85 |
| 4,522,581 | 9/1984 | Schad | 425/534 |
| 4,528,152 | 7/1985 | Aoyama et al. | 264/87 |
| 4,539,031 | 9/1985 | Fecik et al. | 65/106 |

FOREIGN PATENT DOCUMENTS

| | | | |
|---|---|---|---|
| 0939420 | 10/1963 | United Kingdom | 162/388 |

*Primary Examiner*—S. Leon Bashore
*Assistant Examiner*—V. Manoharan
*Attorney, Agent, or Firm*—William E. Mouzavires

[57] ABSTRACT

In the continuous vacuum forming of articles from a fibrous slurry, e.g. from paper pulp, a plurality of two-piece hinged moulds are mounted on a transport apparatus 1 which transports the moulds stepwise in a loop. The internal surfaces of the moulds are defined by wire gauze of mesh 107,109 and the moulds are connected to a source of suction.

The moulds, with the suction applied, are moved through the fibrous slurry contained in a tank 43, whereupon fibres are deposited on the mesh 107,109, much of the water being drawn off by the suction. The mould passes through a drying station, where warm air is sucked through the mould, further drying the article.

The transport apparatus 1 is movable pivotably about an axis 6 by means of a fluid-operated ram 25. At the top of the path, the mould and the article therein are lowered onto a pin 61, a plurality of which are situated on an endless conveyor 59. By means of rods 81,81', attached to the mould pieces, the mould is opened, and the transport apparatus is lifted, leaving the article on the pin 61. After cleaning with a spray 65, the mould is then ready to undergo another cycle.

29 Claims, 8 Drawing Figures

MOULDING

DESCRIPTION

The present invention relates to an apparatus for continuously vacuum forming articles, and a method of vacuum forming articles using the apparatus.

It is known to make hollow articles such as flasks by pressure moulding in which a slurry, such as paper pulp in water, is introduced into a three part mould with the slurry being pressed against a perforated moulding surface of the mould by the hydraulic effect of the water, allowing the water to pass through the moulding surface and a layer of pulp to build up on the moulding surface. After a prescribed period of time the flow of slurry is stopped and hot compressed air introduced into the mould to force out excess water, and partially dry the pulp before the mould halves are separated and the article dried further.

The disadvantages with such a system are that firstly, the pressure tends to separate the mould parts resulting in the formation of unwanted holes at the joint, and secondly, there is a tendency for thickening to occur at the lowermost part of the mould as a result of sediment settling there. Thirdly, the known pressure moulding system requires the moulded article to be removed by hand from the mould and therefore does not lend itself to continuous production techniques which can be automated.

According to one aspect of the present invention there is provided apparatus for use in vacuum forming an article from a fibrous slurry, comprising a mould, which mould comprises at least first and second members having a respective moulding surface which, when the first and second members are in their closed positions, define the shape of the article to be moulded, which moulding surfaces are defined by a respective fluid permeable member which is supported by a rigid part of each mould member, a chamber being formed in each mould member which is in communication with the fluid permeable member and a port being provided in each mould member by means of which, in use, suction can be applied to the said chambers, and an aperture in the mould for admitting the fibrous slurry into the mould to be drawn onto the moulding surface, and means linking either directly or indirectly the first and second members for controlling the opening and closing thereof in a non-linear manner.

In a preferred embodiment the first and second members of the mould are linked together by a hinge. The joint line for the mould may or may not intersect with the axis of the hinge. Conveniently, actuating means are provided for opening and closing the first and second mould members and one of the opening and closing means may be spring means. Preferably, the mould members are pivotally mounted on a support tube which serves as a manifold for a suction line. The spring means preferably closes the mould members against a positioning arm depending from the support tube.

The hinge ensures alignment of the mould halves and can improve the release of mouldings from the moulds. The use of a hinge also allows mouldings with no draw tape to be produced. By hinging the moulds at the back the production of mouldings can be automated, the number of moving parts close to the pulp is kept to a minimum, and the mouldings can be removed without any manual handling. Furthermore, hinging the moulds at the back means that when opened, the moulds can be presented for washing, therefore making best use of available space. Hinging of the moulds allows them to be peeled away from the mouldings. This ensures that the mouldings are not distorted during release. By arranging the mould joint line appropriately, the arc described by the opening mould can be used to assist physically in the removal of the moulding.

Apparatus comprising a mould of the above-described type may be used in the manufacture of necked hollow articles such as bottles or articles with a positive release draw taper such as bowls or dishes. A demoulder is not required with the split mould of the invention and the mouldings may be removed from the moulds during movement thereof. Therefore, the mould lends itself to use in automated production.

Preferably, the apparatus comprises a plurality of said apparatus mounted on a transport apparatus which is movable in an endless path, suction means for applying suction to the moulds, a tank containing the fibrous slurry, air heating means for enabling heated air to be drawn into the moulds, actuating means to open the mould to release the moulded article onto conveyor apparatus, and means for closing the mould members prior to the slurry tank.

In one embodiment drive means is provided to move the transport apparatus in a continuous manner. In another embodiment the drive means moves the transport apparatus in a stepwise manner. The apparatus further comprises conveyor apparatus carrying moulding retaining pins, which apparatus is moved in synchronism with the transport apparatus, means for oscillating the transport apparatus in synchronism with the movement of the moulds to position the mould over a moulding retaining pin and to displace the mould relative to the retaining pin ready for onward movement towards the slurry tank.

Preferably, the apparatus further comprises a spray nozzle disposed between the slurry tank and the heating section for spraying water into the aperture in the mould to remove unwanted fibrous deposits. Conveniently; the apparatus further comprises means for retaining the mould members in an open position, and spray means for spraying cleaning fluid into the open moulds.

Preferably, the apparatus further comprises a restrictor positioned in the slurry tank, movable between a first position in which it fits into the aperture of a mould and a second position in which it is positioned clear of the mould, and preferably comprises a tube, having a collar. Preferably, in the first position the tube fits into the aperture of a mould and the collar fits substantially sealingly onto the mould, around the aperture. Slurry drawn into the mould must thus pass through the tube which is situated in the aperture of the mould.

The transport apparatus preferably comprises a pair of transversely spaced chains entrained around respective pairs of sprockets. A plurality of transverse rows of moulds are carried by the chains by a support tube which serves as a suction manifold. Flexible pressure hoses connect the chambers in the mould members to the suction manifold The suction manifold has a concertina connection which is engageable with ports communicating with a source of suction. Preferably only one concertina connection is provided at one transverse side of the machine, but additional connections may be provided along the suction manifold to ensure adequate and even flow from each of the moulds.

A sleeve valve arrangement is provided to connect the moulds to the source of suction during immersion in the slurry and this comprises a first sleeve which is rotatable with the chain sprocket and which has apertures therein which align with the concertina connection of the mould support tube. A further sleeve disposed within the first sleeve and concentric therewith has an aperture therein which determines when suction is applied to the moulds in dependence upon mutual alignment of the apertures.

Preferably a fluid-operated ram controls the oscillation of the transport apparatus with respect to the conveyor apparatus.

The actuating means to open the mould may comprise a pair of levers pivoted about a shaft carried by the support tube. Preferably each lever fixedly carries arms which independently control movement of the two mould members The arms carry a roller which engages with an actuating bar, conveniently T-shaped, which is actuated in synchronism with the ram so as to move the levers in a direction to open the mould members when the retaining pin is received within the mould aperture, thus causing the moulded article to be removed from the mould.

Once in the open position, indexing movement of the moulds results in the rollers moving from the movable actuating bar to a fixed abutment which retains the levers in the open position. Conveniently, the moulds pass to a washing station before the abutment terminates to allow closure of the mould members.

Variable suction may be provided by two suction sources of different strengths, and there may be a valve to select which suction is applied to the suction manifold. The valve may be controlled by a timing device, e.g. by a microprocessor, such that each suction may be applied for a predetermined time.

According to another aspect of the present invention there is provided a method of vacuum forming moulded articles using said mould comprising introducing the mould into a tank of fibrous slurry with the aperture in the mould submerged in the slurry, applying suction to said mould, whereby the slurry is drawn into the mould and a layer of fibrous pulp deposited on the moulding surface, removing the mould from the slurry and transporting it to a heating station where heated air is drawn through the mould by suction applied to the mould, transporting the mould to an article release station, opening the first and second mould members to release the moulded article therefrom, and transporting the mould towards the slurry tank, and closing the mould members prior to introducing the mould into the slurry tank.

Suction of fibrous slurry into the mould sometimes produces articles having undesirable characteristics A sharp ridge may form on the part of the article moulded near the aperture, because the relatively rapid passage of slurry through the aperture may not allow sufficient deposition of slurry in that area. Hence, it is preferable to draw the slurry into the mould via a restriction which is positioned in the aperture during the drawing of slurry into the mould and which is withdrawn when the slurry has been drawn into the mould. The restriction shields the boundary of the aperture and allows more deposition to occur and due to the faster flow of slurry, the fibres at the base are agitated and are not deposited so much. Preferably, the restriction abuts substantially sealingly around the aperture so that slurry is drawn into the mould only through the restriction.

The strength of the suction may be varied while the suction is applied. Preferably, a first, relatively weak, suction is applied, then a second, relatively strong, suction is applied. The initial, relatively weak, suction draws the fibrous slurry into the mould and allows the pulp particles to abut the fluid permeable member relatively gently. It has been found that this reduces the tendency for the particles to become lodged in, and thereby to block, the fluidpermeable member.

In one embodiment the transport apparatus is moved in a continuous manner and the opening of the mould releases the moulded article onto a conveyor surface, which is preferably a plain surface. This embodiment is particularly suitable for producing dishes or bowls on open moulds where a take off mould or support pin is not required. In the case where the moulds are for producing bottles or the like articles, a support mechanism is called for to avoid damage of the moulded article on release from the mould. Thus, in another embodiment of the invention the method further comprises introducing an article retaining pin into the mould aperture at the release station, and displacing the mould members relative to the retaining pin to allow onward transport of the mould towards the slurry tank. In this embodiment the mould is conveniently conveyed in a stepwise manner between the various stations.

In either case, the use of a demoulder is not required as the use of a mould of two or more parts makes possible easy removal of the moulded article. Thus, with the mould of the present invention the process is simplified and is particularly suitable for continuous production lines. That is to say, production of the moulded articles can be automated.

In order to assist demoulding of a moulded article, it may be desirable to apply a compressed fluid, preferably air, briefly to the interior of the mould when the mould members are separated, in order to dislodge the article from the fluid-permeable member. Only a low pressure, of the order of a few centimetres or tens of centimetres of water, need be applied, and in any case, if a high pressure were applied, as in pressure moulding techniques, distortion or destruction of the article might result.

Preferably, the method further comprises directing a spray of water into the mould aperture to remove unwanted fibre deposits formed therearound, which spray is located between the slurry tank and the heating station.

Conveniently, after removal of the moulded article, the mould members remain open and pass to a washing station where the mould members are sprayed with cleaning fluid.

Vacuum forming has the advantage of enabling a moulding of relatively constant wall thickness to be produced relatively cheaply, and gives rise to a moulding of a smoother internal finish. The constant wall thickness makes the moulding easier to dry, lighter to transport and easier to macerate. Vacuum forming enables a woven wire gauze to be used in place of the perforated brass sheet used in pressure moulding. The use of wire mesh gives a much smoother finish to the product. The wire mesh cannot be used satisfactorily with pressure moulding as the fibres tend to become wrapped round the wires.

Chain drilling of the mould is required when using a perforated plate and this can be dispensed with when a mesh is used so enabling a lighter mould to be used and consequently lighter support machinery. Typically the drainage holes in the mould are on a ⅜" (9.56 mm) square pitch. Lateral drainage occurs between the underface of the mesh and the supporting surface of the mould.

The present invention will now be described further hereinbelow, by way of example only, with reference to the accompanying drawings, in which.

Figure 6:
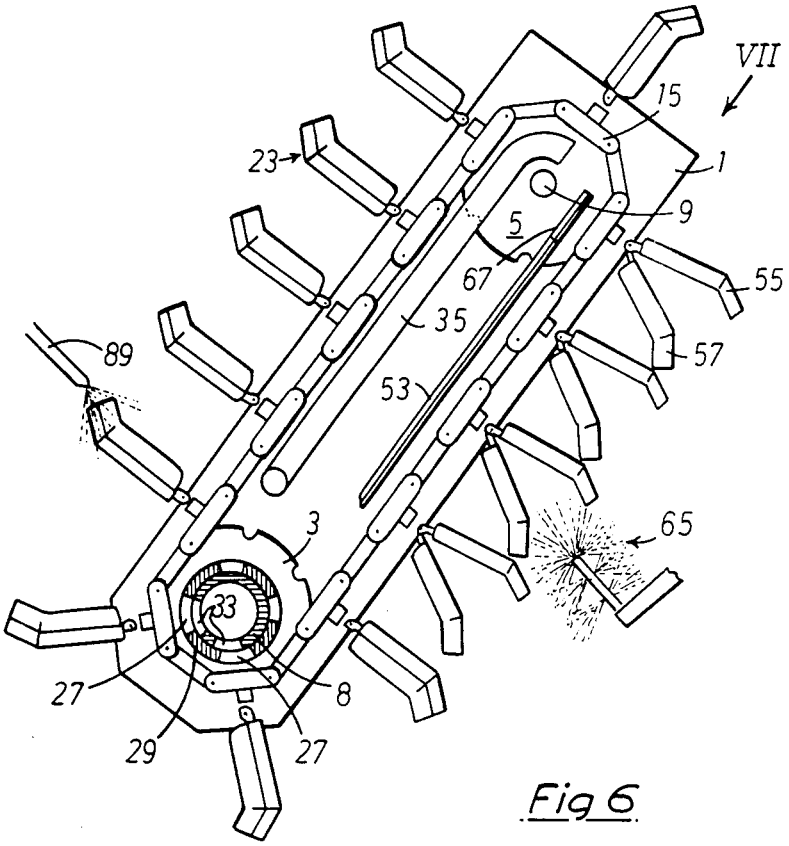
Figures 5, 5A:
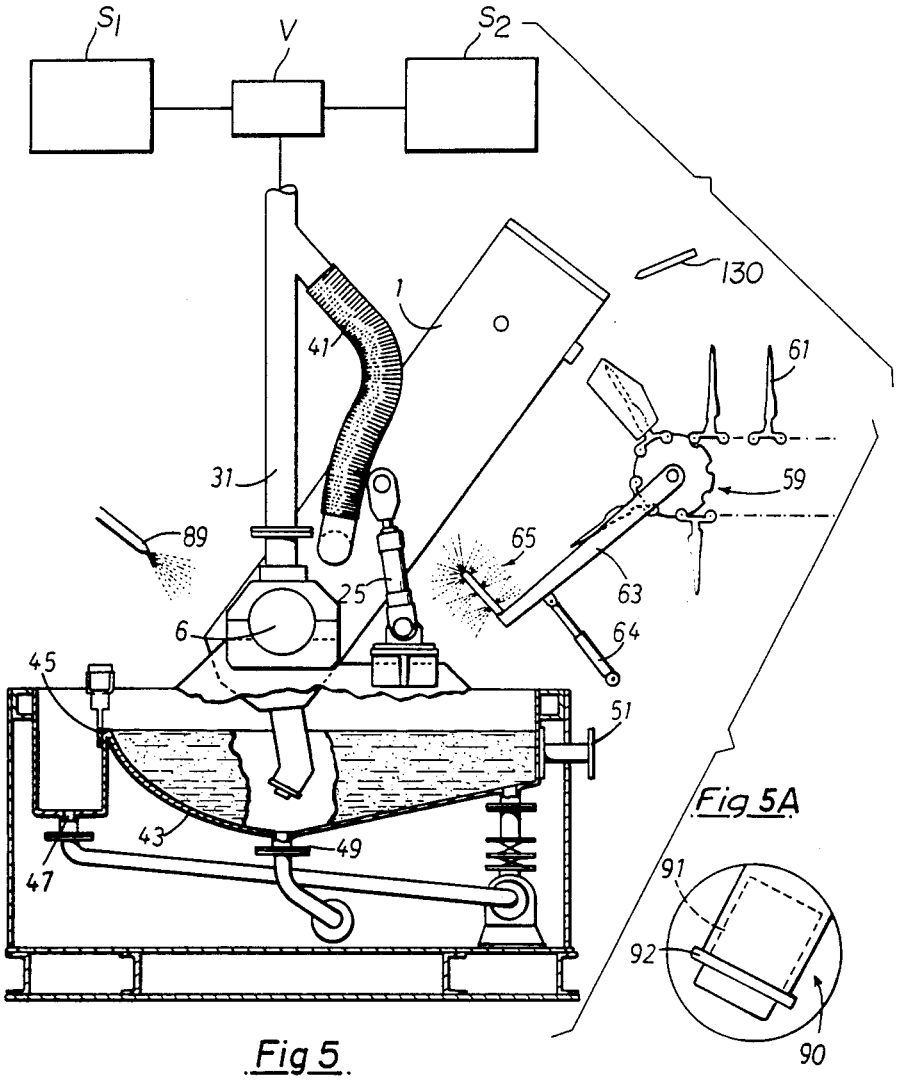
FIG. 5 is an end view of an apparatus in accordance with one aspect of the present invention.
Figure 7:
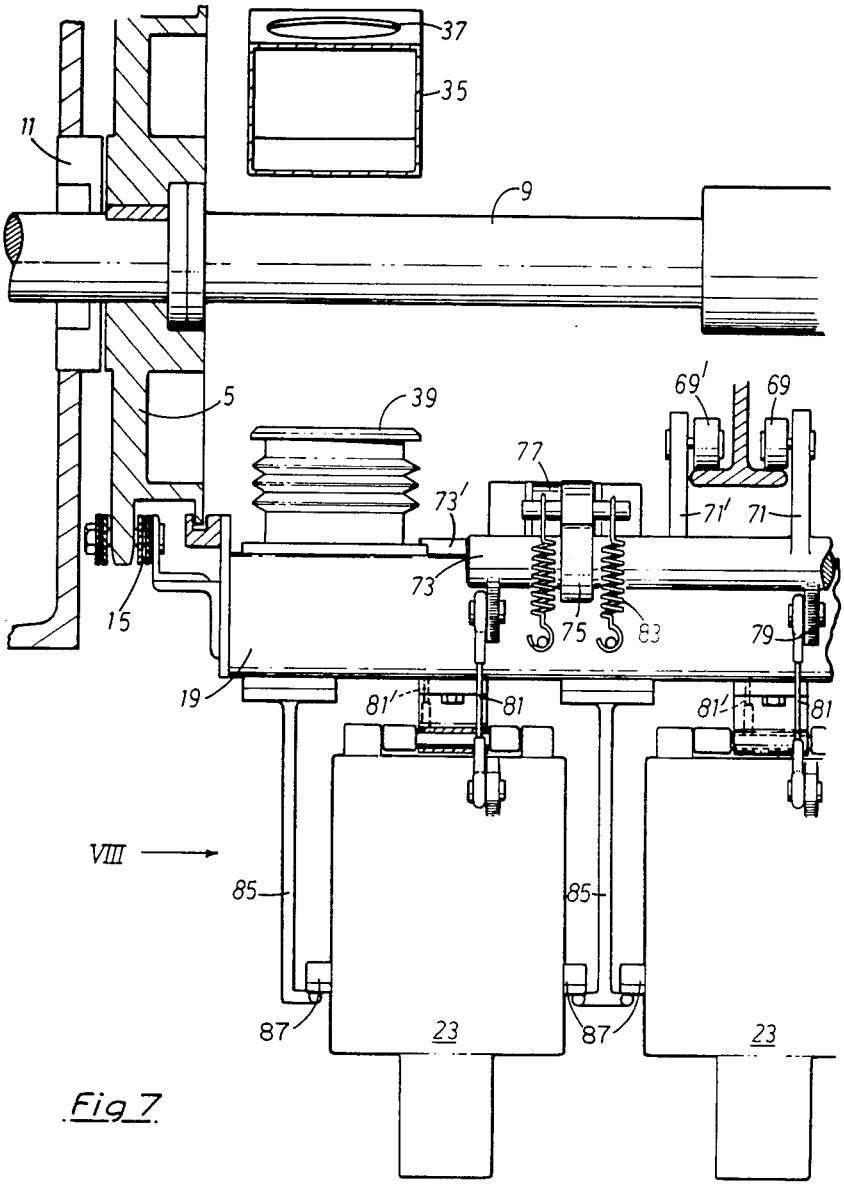
Figure 8:
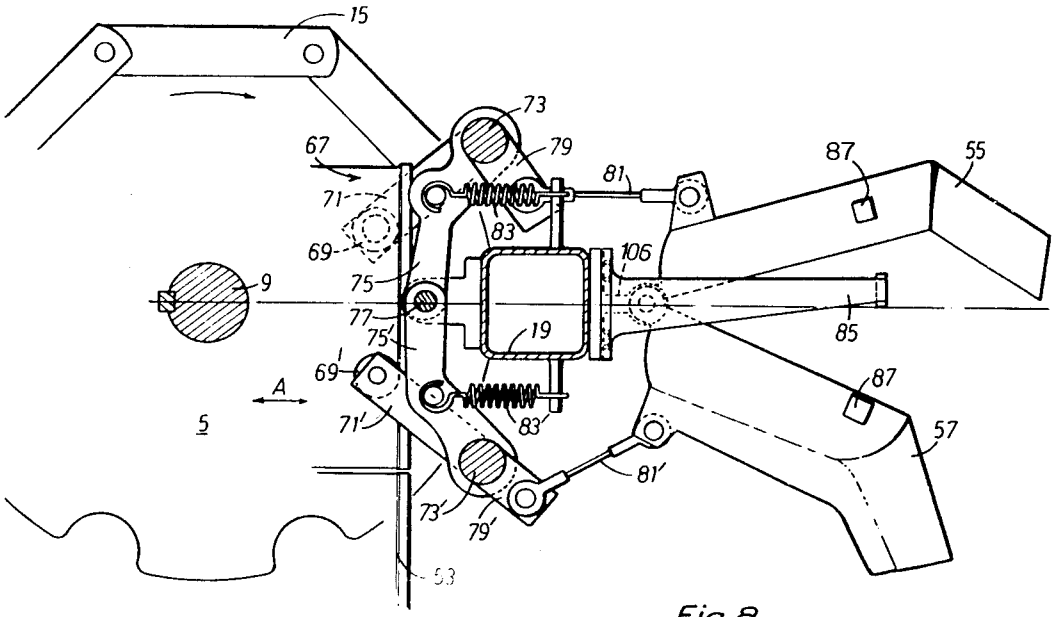

FIG. 5*a* is a detail view of a portion of the apparatus of FIG. 5;

FIG. 6 is an end view of part of the apparatus of FIG. 5;

FIG. 7 is a fragmentary view in greater detail looking in the direction of arrow VII in FIG. 6 showing one side of the transport mechanism for the moulds and the opening and closing mechanism for the moulds, and FIG. 8 is a fragmentary view in the direction of arrow VIII in FIG. 7 of the opening and closing mechanism for the mould.

Figure 1:
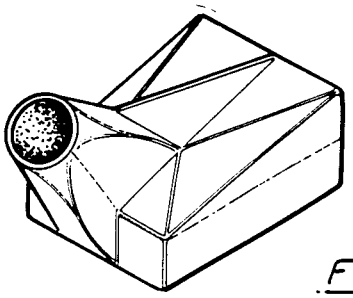
FIG. 1 is a perspective view of an article which can be manufactured from the mould described herein.
Figure 2:
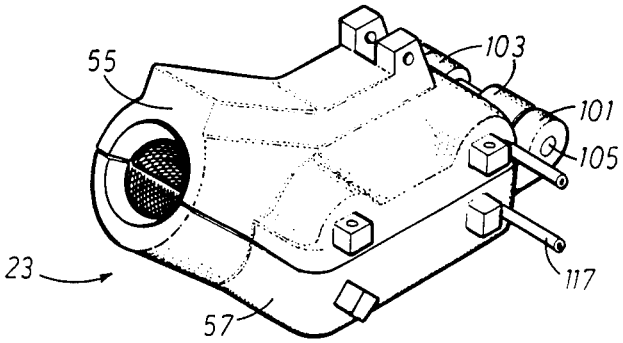
FIG. 2 is a perspective view of a mould shown in the closed position for manufacturing the article shown in FIG. 1.
Figure 3:
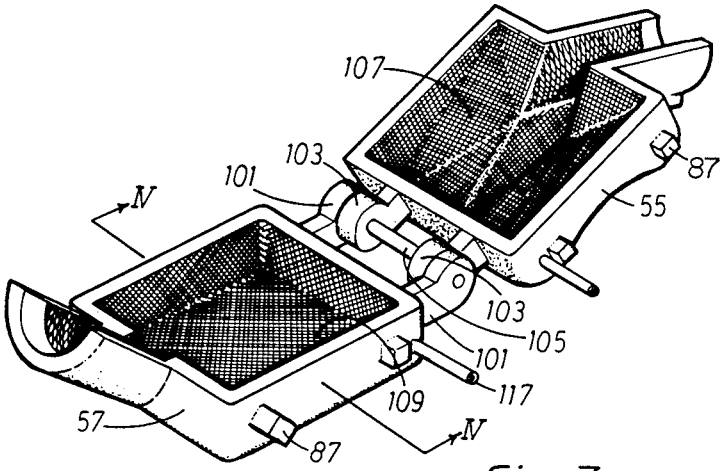
FIG. 3 is a perspective view of the mould of FIG. 2 in an open position.
Figure 4:
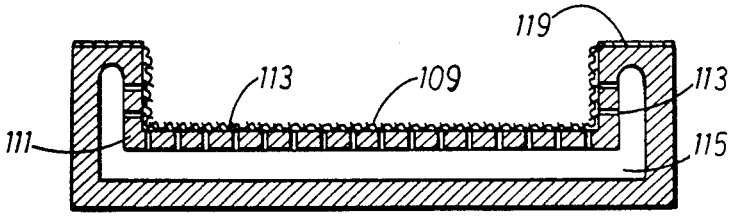
FIG. 4 is a cross section on line IV—IV of FIG. 3.

Referring to the drawings, FIG. 1 shows a perspective view of the article manufactured in the mould shown in further detail in FIGS. 2, 3 and 4. The article illustrated is a disposable urine bottle and is manufactured from a paper pulp by vacuum forming using illustrated mould 23. The shape of the article dictates that a two piece mould be employed and the first and second members 55, 57 of the mould are shown in their closed position in FIG. 2 and in an open position in FIG. 3 to illustrate the internal configuration. Preferably, as illustrated, the two parts of the mould 55,57 are hingedly connected together, each of the parts having a pair of lugs 101, 103 with a hinge pin 105 being received in respective bores in the lugs to render the two parts pivotal with respect to one another. Each part of the mould has a respective mould surface 107, 109 defined by a fluid permeable material such as a gauze or mesh. FIG. 4 shows a cross section through member 57 from which it will be seen that the fluid permeable material defining the mould surface is supported by a rigid member 111 which has a plurality of holes 113 therein which communicate with a common chamber 115. The chamber 115 communicates with a passage which emerges from the mould by way of a pipe 117 for connection with a suction line. The other member 55 is constructed in a similar manner. The material forming the mould surface 109 is secured around the edges of the mould by a plate 119.

In the illustrated embodiment the open neck of the article serves as an opening for admitting the fibrous slurry into the mould. The mould is provided with lugs 87 whose function will be described hereinafter. The two part construction of the mould facilitates easy release or ejection of the moulded article. A similar two part construction may be employed in the manufacture of other moulded articles such as bowls and dishes where the two part arrangement and the angular movement which occurs therebetween can be employed to benefit in release/ejection of the moulded article.

The use of a moulding transfer device (demoulder) is unnecessary with the split mould and the split may be disposed in such a position as to aid ejection of the moulded article. For example, this is the case if the split line, of the mould is off-set from the axis of the hinge connecting the two mould parts.

Referring now to FIGS. 5 and 6 there is shown apparatus for use in the continuous manufacture of vacuum moulded articles, which apparatus may be operated automatically. The apparatus comprises a tank 43 which is fed with a fibrous slurry by way of an inlet 51. The slurry preferably comprises 1% paper pulp in water. A weir 45 maintains a constant level of slurry in the tank. A drain outlet 49 is provided for the tank 43 and an over-flow outlet 47 is provided for the excess slurry which flows off from the tank. The slurry is supplied to the tank by a suitable feed mechanism.

A mould transport apparatus comprising a frame 1 is mounted for pivotal movement about an axis 6 which is co-axial with a tube 8. A hydraulic ram 25 is provided for controlling the pivotal movement of the frame in an oscillatory manner between first and second end positions described further hereinafter. A plurality of moulds 23 are carried by the transport apparatus. Means is provided for applying suction to the moulds and a spray nozzle 65 is provided for washing the moulds. The spray nozzle is arranged to be reciprocated by suitable means 64, such as an hydraulic or pneumatic ram. A conveyor apparatus 59 is provided for holding and transporting away the moulded articles after release from the moulds.

A restrictor 90 is situated in the slurry tank, below the surface of the slurry. The restrictor comprises a tube 91 which can fit into the aperture of the mould, and an annular collar 92 which is for abutment against the outside of the mould around the aperture. The restrictor is movable by a hydraulic ram (not shown) between a first position (shown in dotted lines in FIG. 5), wherein the tube 91 is inserted into the aperture of the mould and the collar 92 abuts the face of the mould around the aperture, and a second position (shown in full lines in FIG. 5) wherein the restrictor is positioned clear of the mould.

Referring to FIG. 6, the transport apparatus comprises endless chain means 15 entrained around respective sprockets 3, 5 which are carried by a shaft 9 and by a sleeve 29, respectively. The shaft and sleeve are journalled for rotation in the frame by way of bearings 11 (see FIG. 7). The tube 8 serves as a fluid pipe through which the water from the slurry is drawn. In the illustrated embodiment a pair of spaced apart chains 15, are provided at opposite sides of the frame and these are interconnected by a plurality of support tubes 19. In the illustrated embodiment each support tube 19 carries a plurality of moulds disposed side by side, but it will be appreciated that each support tube 19 may carry only one mould. The hinge pin 105 of each mould is received in a respective bracket 106 which depends from the support tube 19. As well as location points for the moulds the support tubes 19 serve as suction ports and flexible pressure lines (not shown) connect the suction port to the two parts of the mould by way of the ports 117. A concertina connection 39 is provided at the end of each support tube 19 and this serves to co-operate with passages leading to a suction source. The suction source comprises two suction sources, a strong source S, and a weak source $S_Z$, connectible selectively to the apparatus by means of a switch-over valve V.

The frame 1 supports a suction box 35 which is connected by way of a suction tube 41 to the source of suction. The suction box 35 has a plurality of spaced apart suction ports 37 and the concertina connection 39 is engageable with the suction box 35 whereby when the concertina connection overlies the ports 37 suction is applied to the moulds.

The support tube may be fabricated from an inverted U-section channel member and a plate welded across the open mouth of the U—to form the closed section, the plate preferably being disposed adjacent the moulds.

The concertina connection 39 is also co-operable with the sleeve 29 which is rotatable in synchronism with the sprocket 3. The sleeve 29 has apertures 27 with which the concertina connection 39 aligns, and the tube 8 which is concentric with the sleeve 29 has one or more apertures 33 therein which determine when suction applied to the interior of the tube 8 by way of the suction line 31 is applied to the concertina connection and hence to the moulds.

A mechanism is provided for controlling the opening and closing of the mould members 55, 57. This is illustrated most clearly in FIGS. 7 and 8. Two shafts 77 are disposed at opposite ends of the suction tube 19 and are carried thereby, and each has mounted thereon for pivotal movement two arms 75, 75' which extend in opposite directions from the suction tube 19. Only one of the shafts 77 is shown in FIG. 7. Each carries fixedly at its end remote from the shaft 77 a respective shaft 73,73'. The shaft 73 has depending therefrom arms 71 and 79 disposed at 90° to one another and the shaft 73' has arms 71', 79', depending therefrom and lying in approximately the same plane to one another. The arms 71, 71' carry at their ends a respective roller 69 69' whilst the arms 79, 79' carry a respective rod 81, 81' which may, as illustrated, have rose jointed ends.

Alternatively, and more preferably, the rods 81, 81' may comprise spring members which can collapse if movement of the mould members in the closing direction is obstructed. For example, each rod may comprise one or a pair of flexible strips, in the form of a leaf spring, which will buckle in compression, or may comprise a compensating link having a compression spring. The rod 81 is secured to a lug on one of the mould members 55 and the rod 81' is secured to a lug on the other of the mould members 57. A respective spring 83, 83' acts between the support tube 19 and the arms 75, 75' to bias the two mould members into their closed position.

A positioning mechanism is provided to ensure that the mould members 55, 57 are in the correct position when closed. This comprises for each mould or pair of moulds an arm 85 which is secured to and projects from the support tube 19 and a respective lug 87 on the mould members 55, 57. On closing of the mould members under spring action, the lugs 87 contact the arm 85.

The rollers 69 are co-operable with an actuating mechanism, which in the illustrated embodiment comprises a T-shaped bar 67. The T-shaped bar is movable in a direction indicated by the arrow A. A further T-shaped bar 53, which is fixed with respect to the frame and which runs along the length of the frame is also provided. This serves to retain the mould members in their open positions as will be described further hereinafter.

The conveyor apparatus 59 comprises an endless chain or belt entrained around end sprockets and carries spaced apart rows of pins 61. These pins are provided to receive the moulded article as it is released from the mould. An arm 63 which conveniently depends from the frame of the conveyor apparatus carries a spray head which is provided to clean the interior of the moulds. A further spray nozzle 89 is provided whose function will be described later.

The operation of the apparatus will now be described with reference to the sequence of operations performed on the mould starting with immersion of the closed mould into the tank of slurry. The mould is inserted with its open neck lowermost.

The restrictor 90 is moved into its first position, shown in dotted lines in FIG. 5, with the tube 91 positioned in the aperture of the mould and with the collar 92 abutting the mould substantially sealingly around the aperture. At this station, the weak source of suction is applied to the mould as the apertures 33 in the tube 8, the ports 27 in the sleeve 29 and the concertina connection 39 are all aligned. The weak source of suction draws the slurry gently into the mould through the tube portion of the restrictor 90, and allows the pulp particles to abut the gauzes 107, 109 relatively gently. After the weak suction has been applied for a predetermined period, e.g. two seconds, the switch-over valve connects the strong source of suction to the apparatus. Since the collar 92 abuts the mould substantially sealingly, the slurry can only enter the mould through the tube 91 of the restrictor. The mould remains stationary in this lowermost position for a predetermined period of time which is long enough to deposit sufficient paper pulp on the moulding surface, water being drawn through the fluid permeable surface and discharged by way of the suction line. The suction technique gives rise to a more uniform thickness of the moulded article in comparison with pressure moulding.

The use of a restrictor and weak and strong sources of suction further improves the uniformity of the thickness of the moulded article.

Furthermore, the problem of the mould members being forced apart is eliminated. In addition any sediment in the slurry drains out of the neck so avoiding the formation of a base of excess thickness.

The mould is then indexed to the next station and suction is continually applied during this movement and for a stationary period whilst the following mould is in the slurry tank. The mould then moves towards a drying station, and passes or stops at the spray nozzle 89. This sprays water either continuously or intermittently into the neck of the mould to remove any deposits of fibres which have built up around the neck. This ensures that a smooth finish results around the neck of the moulded article The mould moves to the heating station with the concertina connection 39 co-operating with one of a series of suction ports 37 in the suction box. Hot air is thereby drawn into the mould to assist drying. The mould passes sequentially along the transport apparatus through the heating station with suction being applied during the stationary periods. Suction ceases to be applied as the mould rounds the sprocket 5 and the concertina connection disengages from the suction box 35.

The ram 25 operates to lower the mould over one of the pins 61 prior to opening of the mould members 55, 57. When in this position, the T-bar 67 is actuated by a suitable mechanism to move it in a direction away from the support tube 19 and so co-operate with the rollers 69 to pivot the arms 75, 75' about the shaft 77 and so cause the mould members 55, 57 to pivot open, leaving the moulded article located on the pin 61. The ram 25 then actuates to pivot the transport apparatus in an anti-clockwise direction as illustrated, so that the mould clears the moulded article and can be indexed to the next station. On moving to the next station, the rollers 69 are transferred to the T-bar 53 which maintains the mould members in their open positions. The ram 25, of course, reciprocates the apparatus in the clockwise direction so that the following mould is placed on the next pin 61 as the conveyor apparatus 59 has been indexed to its next position. It will be appreciated that this reciprocating action of the transport apparatus is taking place as the mould is moved through the heating station.

The mould then indexes towards the slurry tank, with the members in the open position and comes to a washing station where a water jet is directed into the mould members to clean same. The arm 65 carrying the washing nozzle is reciprocated in synchronism with the transport apparatus so that acting together the moulds are positioned around the spray nozzle 65. Where sufficient clearance can be obtained by reciprocation of the transport apparatus, reciprocation of the spray nozzle can be dispensed with. Further spray nozzles may be provided as required to ensure adequate cleaning. The rollers 69 run off the T-bar 53 resulting in closure of mould member 57 against the positioning arm 85 followed by closure of mould member 55 against the positioning arm ready for the sequence to be repeated In an alternative arrangement the reciprocation of the transport apparatus may be dispensed with and the conveyor apparatus 59 reciprocated so that the pins 61 are inserted into the moulds. The spray nozzle, where it is carried by the conveyor apparatus, is preferably still provided with reciprocating means.

By means of the described apparatus moulded articles of high quality can be produced in a continuous and automatic manner. The conveyor apparatus passes the moulded articles through a final drying station.

In an alternative embodiment of the apparatus, not otherwise illustrated, which is particularly suited to manufacturing bowls or dishes, the transport apparatus is operated in a continuous manner, and the oscillatory motion dispensed with, as the use of a retaining pin to support the moulded article on release from the mould is not required with this type of article. Thus, the moulded article may be transferred directly onto a moving conveyor apparatus on opening of the mould. The mould can be designed to assist ejection of the moulded article by arranging for the split of the mould to be off-set from the axis of the hinge connecting the mould parts. Thus, in the case of an open top rectangular dish, an automatic ejection can be achieved by having the pivot axis disposed equidistant from each end, whilst the split line for the mould parts is off-set from this pivot axis. Thus, on pivoting apart of the moulds the outer edges of the moulds will pivot, say, upwardly, from the base of the article whilst that edge of the mould part which extends past the pivot axis will move downwardly relative to the original position of the base. Thus, the moulded article is moved downwardly and out of the mould. The mould need not be a two-part mould, but may be a mould of three or more parts, e.g. a four-part mould.

The parts of the apparatus which move relative to one another may be provided with proximity sensors which in turn are connected to a master control device such as a microprocessor-controlled device. In this way the various stages of the production of moulded articles can only take place when the parts of the apparatus are correctly aligned with respect to one another.

There may be means 130 for applying compressed air briefly to the interior of the mould when the mould members are separated, in order to dislodge the article from the fluid permeable member. The pressure of the fluid would be low, of the order of centimetres or tens of centimetres, to prevent distortion or destruction of the article.

We claim:

1. Apparatus for vacuum forming articles from a fibrous slurry the arrangement comprising:

a plurality of moulds, each mould formed by at least first and second mould members;

each mould comprising a fluid permeable member supported by part of each mould member and forming a moulding surface on said mould member defining the shape of the article to be vacuum formed;

a chamber in each mould member connected to the fluid permeable member;

a port in each mould member for application of suction to said chambers;

an inlet in each of said moulds for admitting fibrous slurry to be vacuum formed into the mould and onto the moulding surface;

means linking the mould members and controlling the opening and closing thereof in a non-linear manner;

transport apparatus movable in an endless path, said moulds being mounted on said transport apparatus;

suction means for applying suction to said moulds;

a slurry tank fo containing fibrous slurry;

conveying apparatus for receiving moulded articles from the moulds means for opening said moulds to release the moulded articles onto conveyor apparatus;

means for closing the said mould members prior to conveyane to the slurry tank by said transport apparatus;

said conveyor apparatus comprising retaining pins which receive said moulded articles, said conveyor apparatus being movable in synchronism with said transport apparatus; and means for oscillating said transport apparatus in synchronism with the movement of said moulds to position each mould in turn over a retaining pin and for displacing said mould relative to the retaining pin for onward movement towards the slurry tank.

2. Apparatus as claimed in claim 1 further comprising a hinge by which said first and second members of the mould are linked together.

3. Apparatus as claimed in claim 2, in which said mould has an inlet positioned on the opposite side of the mould from the hinge.

4. Apparatus as claimed in claim 2, wherein said first and second mould members, in closed position, abut each other at a plane and wherein said hinge is movable about an axis lying in said plane.

5. Apparatus as claimed in claim 1, further comprising a support tube which serves as a manifold for a suction line, said mould members being pivotally mounted on said support tube.

6. Apparatus as claimed in claim 1, in which said means for closing the mould members comprises spring means.

7. Apparatus as claimed in claim 6, comprising a positioning arm depending from the support tube, said means functioning to close the mould members against said positioning arm.

8. Apparatus as claimed in claim 1, wherein said fluid permeable member comprises a wire mesh.

9. Apparatus as claimed in claim 1, in which said fluid permeable member comprises a woven wire gauze.

10. Arrangement as claimed in claim 1, comprising a drive means to move said transport apparatus in a continuous manner.

11. Arrangement as claimed in claim 1, comprising a drive means to move said transport apparatus in a stepwise manner.

12. Arrangement as claimed in claim 1, comprising means for retaining said mould members in an open position.

13. Arrangement as claimed in claim 1, comprising a restrictor positioned in said slurry tank, movable between a first position in which it fits into said inlet of a mould and a second position in which it is positioned out of the mould.

14. Arrangement as claimed in claim 13, in which said restrictor comprises a tube having a collar.

15. Arrangement as claimed in claim 14, comprising a mould in which in said first position, the said collar fits onto and substantially seals the mould around said inlet.

16. Arrangement as claimed in claim 1, comprising a pair of transversely spaced chains entrained around respective pairs of sprockets.

17. Arrangement as claimed in 16, comprising a plurality of transverse rows of mould carried by said chains.

18. Arrangement as claimed in 17, comprising pressure hoses which connect said chambers in the mould members to said suction manifold.

19. Arrangement as claimed in 18, in which said suction manifold comprises a concertina connection connected to ports of a source of suction.

20. Arrangement as claimed 19, comprising one concertina connection at one traverse side of the machine.

21. Arrangement as claimed in claim 1, comprising a sleeve arrangement connecting the moulds to the source of suction during immersion in the slurry, comprising a first sleeve rotatable with said chain sprocket and having apertures therein aligned with concertina connection of the mould support tube.

22. Arrangement as claimed in 21, comprising a further sleeve, disposed within the first sleeve and concentric therewith and having an aperture therein which determines when suction is applied to the moulds, in upon mutual alignment of the apertures.

23. Arrangement as claimed in claim 1, in which said means for oscillating the transport apparatus comprises a fluid-operated ram.

24. Arrangemment as claimed in claim 1, in which the means to open said mould members comprises a pair of levers pivoted about a shaft carried by said support tube, each lever including arms which independently control movement of the two mould members.

25. Arrangement as claimed in claim 24, in which the arms include a roller connected to an actuating bar actuated in synchronism with the ram so as to move the levers in a direction to open the mould members.

26. Apparatus as claimed in claim 1, wherein said suction means includes two suction sources having different suction forces.

27. Apparatus as claimed in claim 26, comprising a valve means for connecting one of said suction sources to the suction manifold.

28. Apparatus as claimed in claim 1 further including a spray nozzle for spraying water into the inlet of each mould to remove fibrous deposits.

29. Apparatus as claimed in claim 1, comprising means which apply a compressed fluid to the mould after the mould members have been separated.

* * * * *